United States Patent [19]

Burch

[11] 4,309,979

[45] Jan. 12, 1982

[54] FORCED AIRFLOW FIREPLACE UNIT

[76] Inventor: Delton L. Burch, 309 W. Blanchard St., Henrietta, Tex. 76365

[21] Appl. No.: 955,576

[22] Filed: Oct. 30, 1978

[51] Int. Cl.[3] ..... F24B 7/00

[52] U.S. Cl. ..... 126/131; 126/120; 126/121; 237/51

[58] Field of Search ..... 126/135, 121, 131, 123, 126/130; 237/51

[56] References Cited

U.S. PATENT DOCUMENTS

| | | | |
|---|---|---|---|
| 1,181,454 | 5/1916 | Janney | 126/131 |
| 1,740,996 | 12/1929 | Muir | 126/121 |
| 2,080,323 | 5/1937 | Limoni | 126/121 |
| 2,821,975 | 2/1958 | Thulman | 126/130 X |
| 3,190,282 | 6/1965 | Bauer | 126/121 X |
| 3,995,611 | 12/1976 | Nelson | 126/131 X |
| 4,050,626 | 9/1977 | Awalt, Jr. | 126/121 |
| 4,132,263 | 1/1979 | Stinnett | 126/121 |
| 4,154,214 | 5/1979 | Owens | 126/121 |
| 4,166,444 | 9/1979 | Martenson | 126/123 X |

FOREIGN PATENT DOCUMENTS

| | | | |
|---|---|---|---|
| 249608 | 12/1961 | Australia | 126/121 |
| 2013707 | 10/1971 | Fed. Rep. of Germany | 126/131 |

*Primary Examiner*—Larry Jones

*Attorney, Agent, or Firm*—Sixbey, Friedman & Leedom

[57] ABSTRACT

A forced airflow fireplace unit constituted by an open front firebox shell including interconnected hollow bottom, side, top and back wall members collectively forming a hollow air heating chamber, the bottom member serving as a support surface for a fire on the upper side thereof, an air blower operatively connected into a side wall member for introducing air under pressure thereinto for channelized flow therethrough, exhaust therefrom, flow across through the top, through the sides, downward through the back into the rear of the bottom, through the bottom under the fire support surface, and heated air in the hollow air heating chamber being forcefully expelled through openings in the front of the bottom into an area in which situated.

14 Claims, 7 Drawing Figures

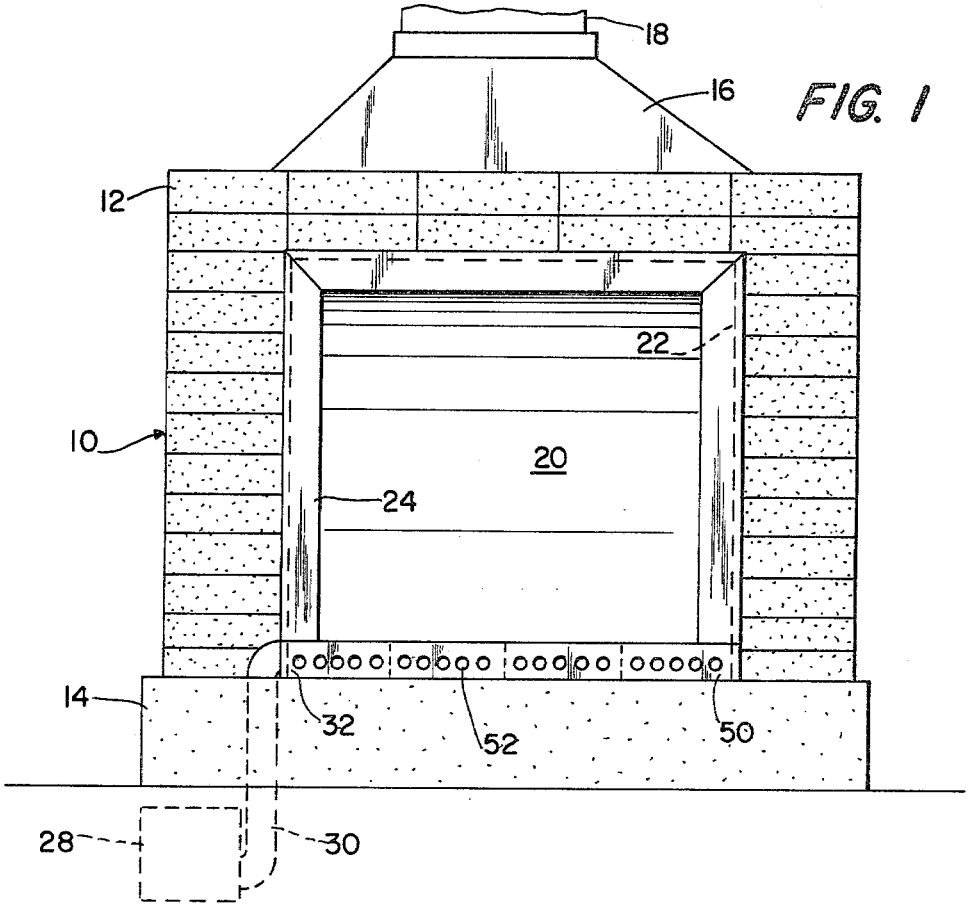
FIG. 1
FIG. 2
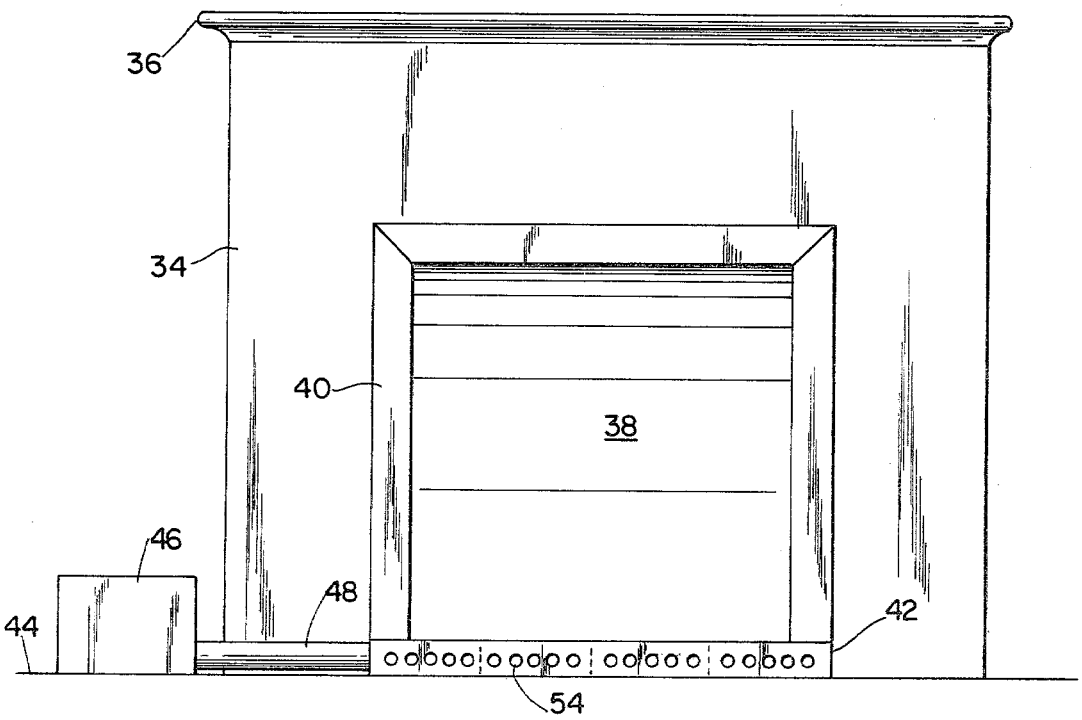

FORCED AIRFLOW FIREPLACE UNIT

BACKGROUND OF THE INVENTION

The present invention relates broadly and generally to fireplace installations in homes and the like, used for the burning of wood, coal, etc., and wherein heat from the open fireplace hopefully radiates or migrates into the room, and with undesired products of combustion vented through chimneys, passage being partly controllable by dampers operable to vary the flue opening in the chimney.

The efficiency of fireplaces, especially of the type containing an open fire with no heat directing and/or forcing means is quite low, and to a large extent the so called "warmth" derived from an open fire in a fireplace resides in visual pleasure of watching the flames, and the actual heat obtained by the observer depends to a large extent on proximity to the fire itself, due to low outward heat radiation.

In addition, low efficiency of fireplace fires is in part due to heat rise losses, in that heat created in a fireplace vents upwardly through the chimney, and further, when burning, the fire also tends to draw air from the surrounding area or room, heated air therein being likewise vented. When fire in a fireplace is extinguished with the damper still being open, this flow of heated air from the room continues.

The present invention is directed to improvements relating to fireplaces in general, and as normally constructed and installed in homes and other structures. More particularly, the invention is concerned with improvements over known attempts for increased efficiency in such units.

DESCRIPTION OF THE PRIOR ART AND BEST KNOWN PRIOR ART

Many attempts have been made to overcome the inefficiencies and drawbacks of fireplace units as hereinabove pointed out, and to generally improve the efficiency thereof. Such attempts have included, for example, apparatus or systems which circulate air through regions of combustion heat to derive heat therefrom, and then force the air into a ducting system, or outward into a room in which the fireplace is situated. Examples of known systems of this type are found in U.S. Pat. No. 4,068,650, Clifford H. Nelson, Jan. 17, 1978; U.S. Pat. No. 4,026,263, Charles M. Boyd, May 31, 1977; and U.S. Pat. No. 2,375,318, E. L. Mudgett, May 8, 1945.

Other known devices include for example, forced-fluid heating units where fluid containing pipes are placed in areas of created heat, and the liquid after being so heated is then circulated in the pipes to another region to be heated. Exemplary of such a system is that shown in U.S. Pat. No. 4,050,441, Elwood R. Horwinski, Sept. 27, 1977.

Other known apparatus, and/or devices, have included heat exchangers in the nature of shells or ductings positioned in heat transfer relationship to fires in fireplaces, and where the air therein is heated and then transferred to a room or area external of the fireplace, either with or without means for forcing the air through and out of the system. Exemplary of such systems are those disclosed in U.S. Pat. No. 3,190,282, W. T. Bauer, June 22, 1965; U.S. Pat. No. 3,866,595, Robert E. Jones, Feb. 18, 1975; U.S. Pat. No. 4,008,706, John M. Buanno, Feb. 22, 1977; and U.S. Pat. No. 3,995,611, Clifford H. Nelson, Dec. 7, 1976.

Other and different apparatus have also been used, but to the best knowledge of the present applicant/inventor all such prior devices have not been as successful as desired, and/or have had drawbacks therein. The present invention is felt to overcome prior drawbacks and to provide a highly efficient fireplace construction or unit for use in homes and the like.

SUMMARY OF THE INVENTION

Generally speaking therefore, the present invention provides a concept and apparatus which increases the heating efficiency of fireplaces, and which can be installed in new homes or in existing fireplaces. To this end, the invention contemplates and teaches a forced airflow firebox unit for installation either as the firebox in newly constructed fireplaces or installed in existing fireplaces. New installations can be effected with little or no extra cost to a prospective home owner due to a saving in cost of firebricks normally required in conventional fireplaces and the labor costs of installation thereof. Use of the present airflow firebox is contemplated therefore for the purpose of replacing a conventional fireplace made of firebrick, or for increased efficiency in existing fireplaces.

The airflow box can be made removable for repair purposes, and the unit is so designed that when installed in a fireplace it will add a more pleasing appearance thereto.

Basically, for attaining the substantial increase in heating efficiency the apparatus consists of a forced air system wherein air is forced through a hollow air heating chamber or compartment, which includes hollow sides, top, back and bottom, with the air being circulated into and through the unit by means of an attached blower. The air circulation is such that the air flows initially up the sides, across and through the top, thence down a curvilinear or slanted back to the rear of the bottom and then is forced through the bottom which serves as a support for a fire on the upper surface thereof, to and through outlet holes or openings in the front of the bottom, and which are appropriately positioned in or with respect to a room or space where heat is desired.

Efficiency is increased by passage of the air to be heated through the hollow shell or housing constituting the basic unit, and increased efficiency and better heating results are obtained due in part to the fact that the air to be heated passes through many areas that are producing heat, and especially the air passes through the bottom, the upper surface of which supports a fire, with the coals or fire laying thereon creating the hottest heat available area.

Additional features, advantages and improvements of the present invention will be more readily apparent from the following detailed description of embodiments thereof when taken together with the accompanying drawings in which:

FIG. 1 is a front view of a fireplace with a firebox of the invention mounted therein;

FIG. 2 is a front view of an existing fireplace with a firebox as shown for example in FIG. 3 operatively mounted therein;

Figure 3:
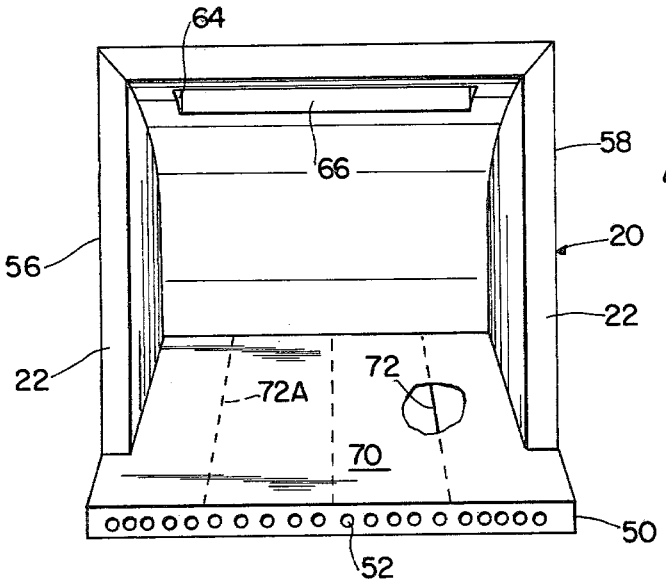
FIG. 3 is a front view of a firebox unit showing in greater detail features of the interior, walls, and bottom, with heated air discharge openings from the unit.

Referring now in detail to the drawings, FIG. 1 discloses a firebox in accordance with the teachings of the invention as incorporated in a fireplace, and the unit is disclosed as being incorporated in a previously existing or constructed fireplace. The fireplace is generally designated 10, and in a usual manner consists of a plurality of exterior bricks joined together by mortar. A hearth is provided in the usual manner, and upon which the remainder of the fireplace is normally superimposed. A hood or the like 16 which is in the nature of a truncated pyramid opens into the flue opening in, and from, the fireplace. This hood serves the purpose of directing flue gases, smoke, etc. from the fireplace for venting through a chimney flue generally indicated at 18.

The firebox of the present invention is inserted into an opening in the fireplace and is generally designated 20. The firebox per se has its outer periphery indicated in broken lines at 22, and after insertion in the fireplace, as will be described in detail hereinafter, a trim, consisting of side plates 24 and top plate 26, are mounted over the front of the firebox and serves as a decorative trim therefore. The trim members can be of any desired type, construction or appearance.

An air blower, such as a centrifugal air blower, is shown in broken lines at 28, and can be of a squirrel cage type or the like. The outlet from the blower is connected by means of duct 30 into the firebox unit 20 at a position proximate the bottom, and front of the unit as at 32. In this form of the invention, where the firebox is built into the fireplace as it is being constructed, the blower 28 and duct 30 can be mounted within the construction, and accordingly hidden from view in the room in which the fireplace is positioned.

FIG. 2 of the drawings generally distinguishes from FIG. 1 that the fireplace 34 is a preconstructed or existing one within a room and includes, for example, a mantelpiece 36 in a usual manner. A firebox 38 is adapted to be fittedly positioned or mounted within the existing fireplace opening and secured in any appropriate manner therein. Again trim at 40 is provided for aesthetic purposes. In this embodiment the bottom member 42 of the firebox, to be described in greater detail hereinafter, rests upon the existing hearth or floor of the structure at 44, and blower 46, and duct or conduit 48 will likewise rest upon this support or floor 44 and may be somewhat exposed. This embodiment differs from that of FIG. 1 in that in FIG. 1 the bottom 50 of firebox 20 is operatively mounted on the hearth 14 as the fireplace is being constructed, and the conduit 30 and blower 28 are hidden from view, being positioned and confined within the building structure.

The firebox units 20 and 38 of FIGS. 1 and 2 are basically the same in structure and function, although some specific differences do exist as will be brought out hereinafter. It is to be noted that in both bottoms 50 and 42, of FIGS. 1 and 2 respectively, there are a plurality of openings respectively designated 52 and 54. These are outlet openings for heated air which is vented or forced into the room at, or in proximity to, the floor of the room in which the fireplace is situated.

Figure 4:
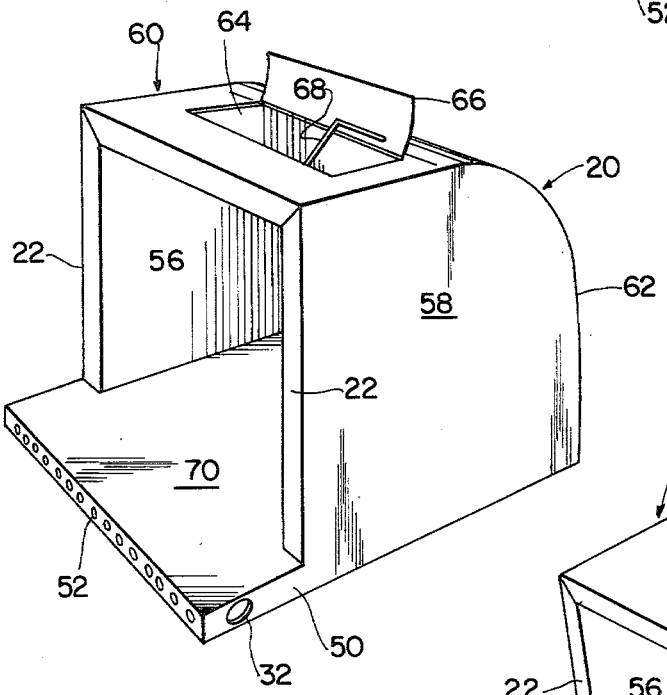
FIG. 4 is a perspective view of a firebox unit showing in greater detail structure thereof including a curvilinear back, forced air inlet opening, and an open damper.
Figure 5:
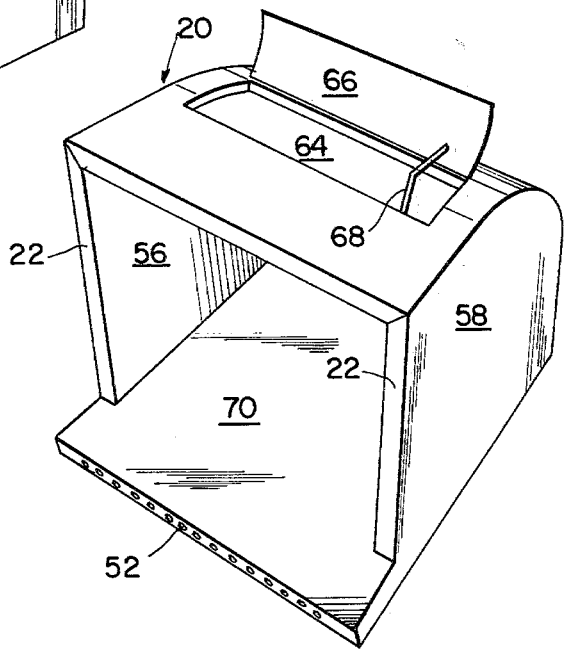
FIG. 5 is a top perspective view of a firebox unit with a damper shown in open position.

The configuration of the firebox units 20 or 38 are better shown in FIGS. 3, 4 and 5. The firebox is in the nature of a hollow shell including the base or bottom member or wall 50, side walls or members 56 and 58, a top wall or member 60, and a rear wall or member 62. In the embodiment shown in FIGS. 3–5 inclusive, the unit shown is designed for inclusion in new construction, such as in FIG. 1, as above described. A flue opening 64 is incorporated in the top wall or member 60 in a usual manner, and operatively associated therewith is a hinged damper 66, and operating means for the damper schematically indicated at 68. These features are of substantially normal construction and operation. It will be noted, as the description follows hereinafter, that the flue opening 64 for this type of unit is substantially smaller than the flue opening of a unit which is to be placed in an existing fireplace, as will be described with respect to FIG. 7 hereinafter.

Attention is invited to the configuration of the rear wall or member 62, which is curvilinear and curvilinearly merges into the top wall or member 60. This serves a multiple function, merging gradually the hollow interior of the rear wall with the top wall for air flow efficiency, and at the same time this angular disposition of the rear wall serves to reflect heat outwardly from the unit into the room. While a curvilinear configuration is shown, this could be angularized.

The various members of the shell are comprised of sheet metal and preferably welded to form the shell or firebox units 20 and 38. Appropriate materials and thicknesses are, of course, utilized. A suitable embodiment of the firebox would include inside sheets or walls of the various members as being of 10 gauge metal, while the outside sheets or walls would consist of 12 gauge metal. The interior sheet 70 of the bottom member is adapted to have a fire built directly thereon. This will create a very high heat area on the floor or bottom of the unit. A plurality of vanes or partitions 72 are interposed between the two sheets comprising the bottom member, as shown in the broken away area of the floor surface in FIG. 3. These vanes or partitions otherwise are indicated by broken lines 72A in FIGS. 3, 6 and 7. The vanes are welded between the sheets forming the bottom member 50 and serve to strengthen the structure and prevent buckling which otherwise might occur because of the fire being built on the upper surface thereof. These vanes additionally serve to create uniform air flow through the bottom, for a more uniform outflow of heated air through the openings 52 or 54. In the disclosed embodiment, four flow channels generally indicated at 74 in FIG. 6, are contained within the interior of the firebox unit, and additionally smaller end channels are formed at 76.

The inner and outer metal sheets forming the various members are spaced to provide hollow chambers in the two sides, top, back and bottom. In a workable embodiment, the spacing between the two sheets is approximately two inches. The hollow chambers within the individual members are all integrated or connected so as to form a continuous hot air or air heating chamber in the firebox.

Figure 6:
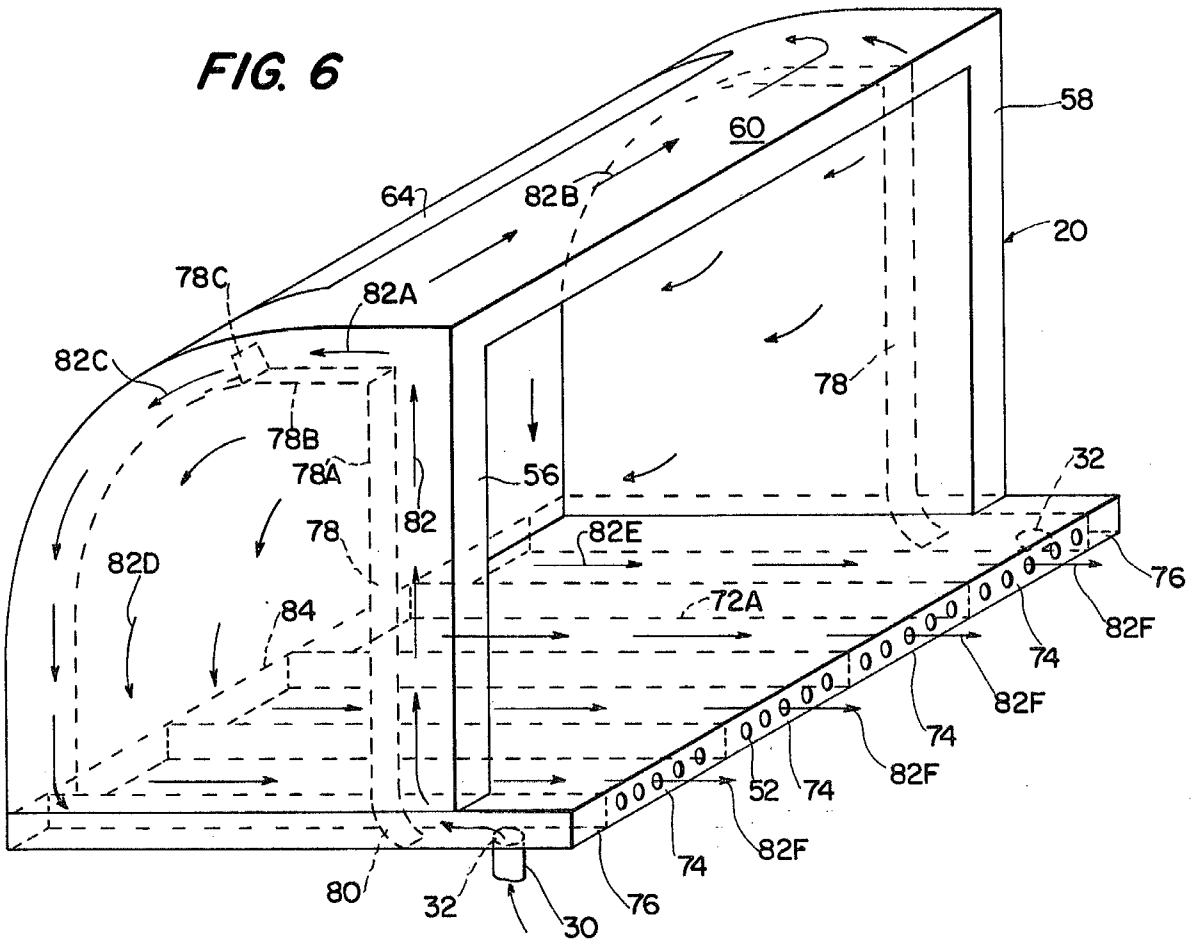
FIG. 6 is a schematic perspective view of a firebox unit adapted for either permanent or removable installation in a fireplace, with airflow indicating arrows.
Figure 7:
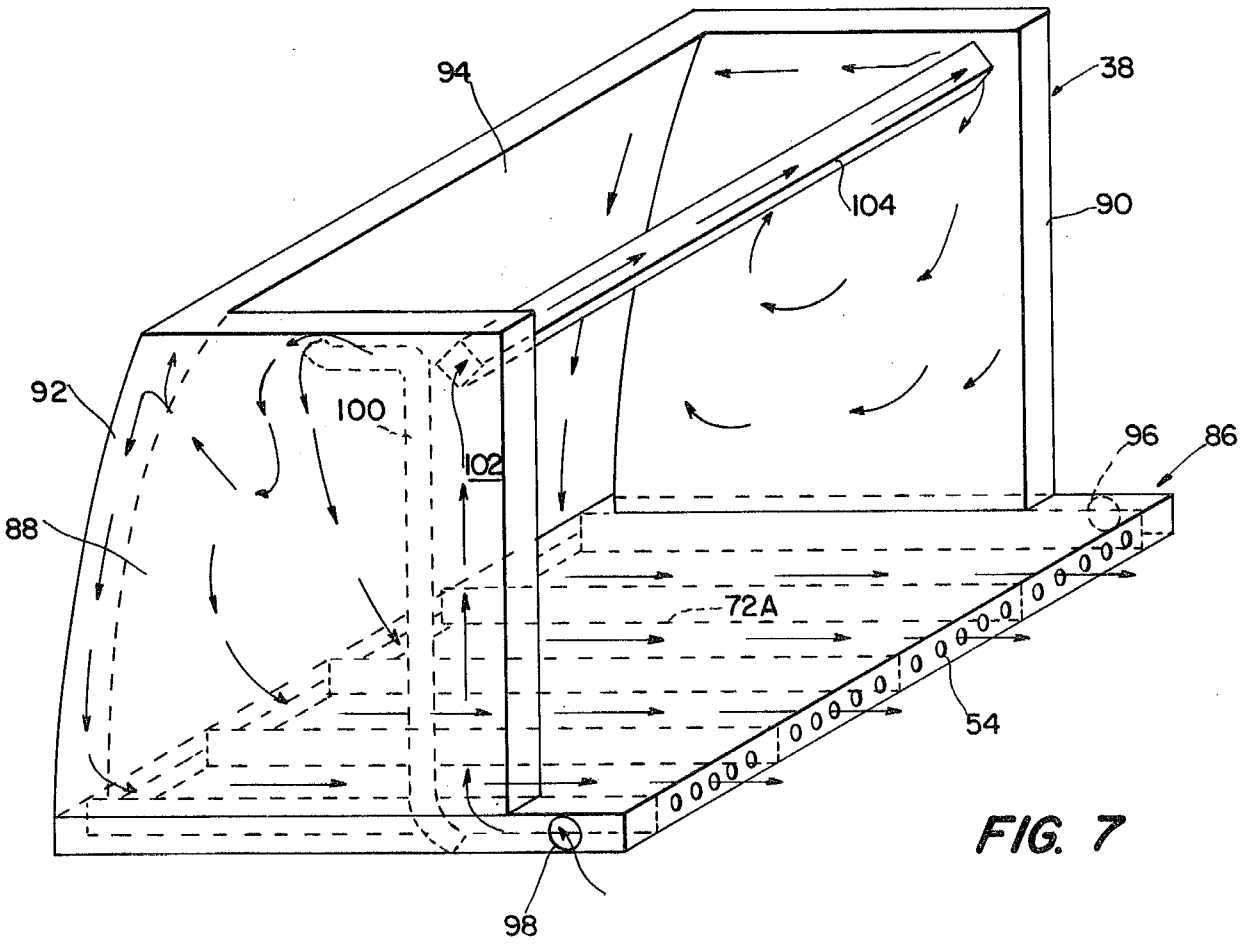
FIG. 7 is a view similar to FIG. 6, disclosing a firebox unit especially adapted for installation in an existing fireplace.

Referring now to FIGS. 6 and 7 it will be noted that conduit or duct 30 is interconnected at 32 into end channels 76 of the bottom 50. The side members 56 and 58 open into these side channels over most of their dimensions. A flow directing vane 78, shown in broken lines in FIG. 6, has its lower forward end 80 curvilinearly or angularly extending into and secured within the channel 76, and then extends upwardly to a position approximately at the location of the inner sheet of the top, this portion being designated 78A, then extends rearwardly within the side wall member as indicated at 78B, and terminates with a rear upwardly directed flap or partition 78C which forms the end of a channel extending from, in essence, the point of interconnection 32 upward through the front portion of the side members 56, 58, through a portion of the top and terminating at 78C. This channel is open into the top 60, the various members all being in open communication one with another. Depending upon whether a single blower is to be used, connected into one side, or blowers are to be interconnected to both side members, the partitions or vanes 78 are appropriately incorporated. It is preferable that the vanes 78 are provided in each side member to facilitate a more universal unit for varied installations.

In operation, the invention serves to substantially increase the heating efficiency of the fireplace. The hollow air chamber formed by the various interconnected and integrated sides top, back and bottom are so designed that relatively cool room air will flow in at the bottom at 32, from conduit 30, and thence will be confined by the channel formed in the side member for flow upward therethrough as indicated by arrows at 82, thence rearwardly as shown by arrows 82A, across and through the interior of the top as shown by arrows 82B, thence downwardly through the rear as indicated by arrows 82C, while at the same time being free to flow through the sides as indicated at 82D due to the hollow interior end, and thence the downward flow will eventually be discharged into the open rear ends 84 of channels 74 for flow forwardly therethrough as indicated by arrows 82E, with the heated air then being discharged through the openings 52 in the front edge of the bottom 50, as indicated by arrows 82F, and into the room into which the fireplace is positioned. The air accordingly from the inlet point at 32 will flow up the sides, over the top, down the back or rear to the bottom then forward under the bottom to the outlet holes or openings in the front. The air blower forces air into and through the firebox to vent into the room.

The air being forced into the shell between the two walls or sheets forming the various members in essence creates a pressure system, whereby air will flow out the holes at the bottom of the front at approximately the same velocity as the air is introduced into the heating chamber. For best efficiency two blower units can be used, one at each side. A single blower, however, does function well. It is of substantial significance to note that hot air exhausts from the unit at the bottom front of the box, and has passed through the bottom directly under a fire located on the upper sheet or surface. The air in passing through the unit accumulates heat gradually and accumulatively at the two sides, the top and back, and then adds accentuated heat in passing through the bottom under the fire. This differentiates from previous constructions and is greatly more efficient.

The embodiment shown in FIG. 7 of the drawings in essence contains the basic essentials of FIG. 6, although being specifically designed to fit inside of existing fireplaces as shown in FIG. 2. This unit or firebox 38, includes the channelized bottom construction generally indicated at 86, side walls or members 88, 90, a rear member 92 and an open top generally indicated at 94. Points of interconnection for blowers are incorporated at 96 and 98. A vane 100 is provided in each of the side members to form a channel at 102 to provide air flow upwardly in the side members, and rearwardly toward the rear, and through the side as indicated by arrows which in this embodiment are not numerically designated. The air flow is substantially the same as in the other form, with the exception of air flow across and through the top, since the top has a large opening therein. A tube 104 inconnects the open interior of side member 88 and the open interior of side member 90 so that air, when a single blower is used and interconnected at 98, will serve to let the air move from the left to the right side at the top of the side member 90, and vent around the side to the back, to the bottom at the rear, and then between the two sheets of the floor and out of the front through the openings 54 in the same manner as described in detail hereinbefore with respect to FIG. 6. The unit of FIG. 7 can be slid inside an existing fireplace and a blower connected to the left side at the front. Again, the fire is built on the floor of the air flow firebox. The blower forces the air up to the top at the left side, and air at that position is let out at the top left, the tube serving to move air to the right side at the top, then around the side to the back, then to the bottom at the back, then between the two floors and out the front. The top of this form of airflow firebox is left open at 94 so that a damper in an existing fireplace will mate therewith and can be operated.

As is obvious, the two units specifically shown and described function essentially in the same manner. When a firebox is installed in new homes, there will be little or no additional cost to the homeowner, because when using this firebox it will save the cost of firebricks that go into a conventional fireplace, and will save a very substantial amount of time for a bricklayer. The unit includes its own damper made into the firebox and therefore a new or additional damper is not necessary. The possibility of installing the firebox of the present invention in an existing fireplace structure in order to obtain the same results is an added factor.

Recapitulating to some extent, the present invention is specifically directed to a forced air system wherein the air is forced through a hollow unit by means of a blower attached thereto. The air circulates through channels provided in side units or members to the top, over and across the top, downward throughout the back of the unit, and under the bottom on which a fire has been built, and thence out through channels to exhaust from outlet holes. The air circulating through the device is not impeded by dividers or the like in the back, in the sides or other portions other than as indicated. The air circulating through the device will pick up heat from the sides, back and bottom of the unit. The forced air system of the invention as distinguished from a free-flow system, provides better results, and particularly since the air passes through many areas that are producing heat, and especially under the bottom where the hottest heat is available, the coals on the steel floor producing an area of attenuated heat, and the so heated air will be discharged into the room, and into the house as a whole.

While different specific embodiments have been shown and described, manifestly minor changes in details of construction can be effected in the so shown and described constructions without departing from the spirit and scope of the invention as defined in and limited solely by, the appended claims.

I claim:

1. A forced airflow fireplace unit comprising an open front firebox shell, said shell including hollow interconnected bottom, side, top and rear wall members collectively forming a continuous hollow air heating chamber, said bottom member having upper and lower surfaces, said upper surface serving as a fire support surface, a plurality of spaced apart vanes within said bottom member extending from front to rear between said upper and lower surfaces defining a plurality of side by side airflow channels extending from the front to the rear of the bottom member, an air blower operatively connected into a said side wall member for introducing air under pressure thereinto, means in said side wall member forming a substantially vertical flow channel therethrough, said channel being separate from the remainder of said side wall member and proximate the front end thereof for directing the flow of air from said air blower upwardly through said vertical channel in said side wall member and into, across and through said top member, said airflow continuing downwardly through said rear member into the rear of said bottom member and forwardly through said side by side airflow channels in said bottom member under said fire support surface, and apertures defined in the front of said bottom member for discharging heated air from said bottom member.

2. A hollow wall open front firebox comprising:

(a) a bottom wall having a fire supporting upper surface;

(b) first and second side walls, a top wall and a rear wall, said bottom wall consisting of upper and lower surfaces spaced by peripheral side and front walls, said top wall in air flow communication with said side walls and with said rear wall at the rear thereof, said rear wall in air flow communication with said side walls and with said bottom wall at the rear thereof;

(c) blower means for introducing air under pressure into said first side wall;

(d) channel forming means in said first side wall defining first and second separate airflow channels therein, said channel forming means directing said pressurized air to flow upwardly in said first airflow channel toward said top wall, through said top wall, down said rear wall, into said bottom wall and forwardly through said bottom wall, whereby said airflow becomes heated by said walls;

(e) a plurality of spaced apart vanes within said bottom wall extending from front to rear between said upper and lower surfaces defining a plurality of side by side airflow channels extending from the front to the rear of the bottom wall; and (f) heated air outlet means comprising a plurality of apertures defined in the front peripheral wall communicating with said side by side airflow channels in said bottom wall for discharging heated air from said bottom wall.

3. A hollow wall open front firebox as claimed in claim 2, wherein said blower means also introduces air under pressure into said second side wall and said second side wall includes channel forming means as in said first side wall.

4. A hollow wall open front firebox as claimed in claims 2 or 3, further including means for circulating said air under pressure into said second airflow channel in said side walls whereby said air is heated therein.

5. A hollow wall open front firebox as claimed in claims 2 or 3, wherein said blower means comprises at least one air blower operatively communicating with said side wall proximate the bottom and forward end thereof.

6. A hollow wall open front firebox as claimed in claims 2 or 3, wherein said vanes include upper and lower edges and said edges are welded to said upper and lower surfaces for additional strength and to resist heat buckling.

7. A hollow wall open front firebox as claimed in claims 2 or 3, including an opening in said top wall for discharging combustion products therethrough and damper means operatively mounted in said opening for controlling discharge therethrough.

8. A hollow wall open front firebox as claimed in claims 2 or 3, wherein said top wall and said back wall are curvilinear and curvilinearly integrated.

9. A forced airflow firebox unit adapted for mounting in a fireplace and to have a fire situated within an opening facing an area to be heated, comprising a hollow walled structural unit including a hollow bottom wall having a lower surface and an upper surface adapted for supporting thereon a fire, hollow side walls spacedly mounted on said bottom wall, means in at least one said side wall defining a substantially vertical airflow channel therein separate from the remainder of the interior of said side wall for introduction thereinto and passage therethrough of air in an upward direction, the remainder of the interior of said side walls in open communication with the interior of said bottom wall, a hollow back wall having the interior thereof in open communication with the rearward end of the interior of said bottom wall and the said remainder of the interior of said side walls, a hollow top wall having the interior thereof in open communication respectively with the upper end of said airflow channel, with said back wall, and the remainder of the interiors of said side walls, a flue connecting opening in said top wall, damper means operably mounted to said flue connecting opening, forced air inlet means having a discharge opening therefrom in communication with said vertical air flow channel, blower means for introducing air under pressure into said forced air inlet means, a plurality of spaced apart vanes within said hollow bottom wall extending from front to rear between said upper and lower surfaces defining a plurality of side by side airflow channels, a plurality of heated air discharge openings in the front end of said bottom wall opening into an area to be heated, said openings communicating with the side by side channels in said bottom wall, whereby actuation of said air blower means introduces air under pressure into said vertical air flow channel for flow upwardly therethrough, through and across the top wall, down through the back wall and through the side by side airflow channels in said bottom wall from rear to front thereof for heating said air and discharging said heated air through said discharge openings in the front end of said bottom wall into the area to be heated.

10. A forced airflow firebox unit as claimed in claim 9, wherein said air flow channels are provided in each said side wall, and blower means are operatively connected to introduce air under pressure into both said channels.

11. A forced airflow firebox unit as claimed in claim 9, wherein said top wall and said back wall are curvilinear and curvilinearly integrated.

12. A forced airflow firebox unit as claimed in claim 9, wherein said walls forming said unit are comprised of sheet metal to facilitate heat transfer from a fire in said opening to the air in said hollow walls.

13. A forced airflow firebox unit as claimed in claim 9, wherein said firebox unit is adapted for removable installation in a fireplace.

14. A forced airflow firebox unit as claimed in claim 13, wherein said unit is sectionalized to facilitate its installation and removal.

* * * * *